US008141525B2

(12) United States Patent
Ogawa et al.

(10) Patent No.: US 8,141,525 B2
(45) Date of Patent: Mar. 27, 2012

(54) V-TYPE ENGINE

(75) Inventors: Kazuhisa Ogawa, Wako (JP); Manabu Hashimoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 80 days.

(21) Appl. No.: 12/470,892

(22) Filed: May 22, 2009

(65) Prior Publication Data

US 2009/0301415 A1 Dec. 10, 2009

(30) Foreign Application Priority Data

Jun. 4, 2008 (JP) ..... 2008-146531

(51) Int. Cl.
*F02B 75/22* (2006.01)

(52) U.S. Cl. ..... 123/54.4; 123/195 C; 123/198 E; 123/41.82 R

(58) Field of Classification Search ..... 123/41.52, 123/41.82 R; 165/135, 136
See application file for complete search history.

(56) References Cited

U.S. PATENT DOCUMENTS

| | | | | | |
|---|---|---|---|---|---|
| 2,525,374 | A | * | 10/1950 | Ruzicka | 123/542 |
| 2,585,083 | A | * | 2/1952 | Bouvy | 123/41.65 |
| 2,966,146 | A | * | 12/1960 | Schweitzer et al. | 123/41.56 |
| 3,581,722 | A | * | 6/1971 | McKellar | 123/556 |
| 3,994,129 | A | * | 11/1976 | Sakurai et al. | 60/298 |
| 4,142,502 | A | * | 3/1979 | Nakano et al. | 123/195 A |
| 5,647,337 | A | * | 7/1997 | Johnson et al. | 123/572 |
| 5,813,384 | A | * | 9/1998 | Lavender et al. | 123/198 E |
| 6,305,168 | B1 | * | 10/2001 | Furukawa | 60/605.1 |
| 6,889,635 | B2 | * | 5/2005 | Geisheker et al. | 123/41.65 |

FOREIGN PATENT DOCUMENTS

| | | | |
|---|---|---|---|
| JP | 53-092013 | A | 8/1978 |
| JP | 58-53640 | A | 3/1983 |
| JP | 10-176543 | A | 6/1998 |
| JP | 2002-030912 | A | 1/2002 |
| JP | 2004-293361 | A | 10/2004 |
| JP | 2007-113404 | A | 5/2007 |

OTHER PUBLICATIONS

Japanese Office Action dated Oct. 12, 2011, issued in corresponding Japanese Patent Application No. 2008-146531.

* cited by examiner

*Primary Examiner* — Noah Kamen
*Assistant Examiner* — Hung Q Nguyen
(74) *Attorney, Agent, or Firm* — Westerman, Hattori, Daniels & Adrian, LLP; William F. Westerman

(57) ABSTRACT

In a V-type engine in which first and second banks arranged in a V-shape are provided continuously to a crankcase, and in which a carburetor is placed at a valley between the first and second banks, the carburetor is placed spaced from the first and second banks. Further, the carburetor is connected to intake ports of the first and second banks via first and second intake pipes, respectively, and first and second heat shield plates each made of synthetic resin are attached to side faces of the respective first and second banks, the side faces facing the carburetor, each of the first and second heat shield plates covering a corresponding one of the side faces and defining a cooling air passage between the heat shield plate and the side face. Accordingly, it is possible to surely prevent heat from the banks from affecting the carburetor in order to prevent percolation in the carburetor even in the case where the engine stops its operation in a high-temperature state.

3 Claims, 7 Drawing Sheets

V-TYPE ENGINE

CROSS-REFERENCE TO RELATED APPLICATIONS

The present invention claims priority under 35 USC §119 based on Japanese patent application No. 2008-146531 filed Jun. 4, 2008. The subject matter of this priority document is incorporated by reference herein.

BACKGROUND OF THE INVENTION

1. Field of the Invention

The present invention relates to an improvement of a V-type engine in which first and second banks arranged in a V-shape are provided continuously to a crankcase, and in which a carburetor is placed at a valley between the first and second banks, the carburetor communicating with intake ports of the respective banks.

2. Description of the Related Art

Immediately after such a V-type engine stops its operation, cooling air stops flowing. Consequently, heat of the banks easily stays in a valley between the first and second banks, which can cause percolation in a carburetor placed in the valley. The percolation makes it difficult for the V-type engine to restart in a high-temperature state. To this regard, the following conventional measure is known. Specifically, an insulator is provided at a joint part between each of the banks and the carburetor, and a heat shield flange is integrally formed on the insulator in such a manner as to extend vertically, thereby the heat between the bank and the carburetor is shielded (see, for example, Japanese Patent Application Laid-open No. 58-53640).

However, in the above conventional measure, the carburetor is joined to the banks with the relatively-thin insulators in between, and such thin insulators have a limited heat shield capability. Accordingly, when the V-type engine in a high-temperature state stops its operation, the heat from the banks might be conducted to the carburetor through the insulators to cause percolation.

SUMMARY OF THE INVENTION

The present invention has been made in consideration of such circumstances, and has an objective of providing a V-type engine that can have excellent restartability in a high-temperature state by surely preventing heat from banks from affecting a carburetor in order to prevent percolation in the carburetor even in the case where the engine stops its operation in a high-temperature state.

In order to achieve the above object, according to a first feature of the present invention, there is provided a V-type engine in which first and second banks arranged in a V-shape are provided continuously to a crankcase, and in which a carburetor is placed at a valley between the first and second banks, the carburetor communicating with intake ports of the respective banks, wherein the carburetor is placed spaced from the first and second banks and connected to the intake ports of the first and second banks via first and second intake pipes, respectively, and first and second heat shield plates each made of synthetic resin are attached to side faces of the respective first and second banks, the side faces facing the carburetor, each of the first and second heat shield plates covering a corresponding one of the side faces and defining a cooling air passage between the heat shield plate and the corresponding side face.

According to the first feature of the present invention, the first and second heat shield plates each define the cooling air passage between the heat shield plate and the corresponding side face of the first and second banks B1 and B2, and cooling air is guided into the cooling air passage while the V-type engine is in operation. Thereby, the banks can be cooled. When the V-type engine in a high-temperature state stops its operation, the first and second heat shield plates interposed between the corresponding first and second banks and the carburetor shield the carburetor from radiation heat from the banks. Furthermore, the carburetor is placed at the valley between the first and second banks while being spaced from the banks, and connected to the banks with the intake pipes, respectively. Accordingly, heat radiation effects of the intake pipes allow less heat to be conducted from the banks to the carburetor. The carburetor can thus be prevented from heating up. Accordingly, percolation in the carburetor can be prevented, and this can contribute to improvement of the restartability of the engine in a high-temperature state.

As described, the first and second heat shield plates play two functions: guidance of cooling air to the surrounding of the first and second banks while the V-type engine E is in operation; and shielding of the carburetor from radiation heat from the banks when the V-type engine E stops its operation. This can contribute to simplification of the structure around the V-type engine.

Further, according to a second feature of the present invention, in addition to the first feature, the first and second heat shield plates attached to the respective side faces of the first and second banks are integrally connected to each other by a bottom plate covering a bottom face of the valley, whereby the first and second heat shield plates and the bottom plate form a single component.

According to the second feature of the present invention, the first and second heat shield plates are integrally connected to each other by the bottom plate to form the single component. Since the single component is integrally formed, not only can the heat shield plates be manufactured at once, this synthetic resin member can be attached to the V-type engine easily and speedily.

Further, according to a third feature of the present invention, in addition to the second feature, a holding part for holding a linear member is integrally formed to the single component.

According to the third feature of the present invention, the holding part holding the linear member is integrally formed to the single component. Accordingly, a holding member dedicated to the linear member does not need to be attached to the V-type engine. This can contribute to reduction in the number of components.

The above description, other objects, characteristics and advantages of the present invention will be clear from detailed descriptions which will be provided for the preferred embodiment referring to the attached drawings.

DESCRIPTION OF THE PREFERRED EMBODIMENT

An embodiment of the present invention will be explained below with reference to FIGS. 1 to 7.

Figure 1:
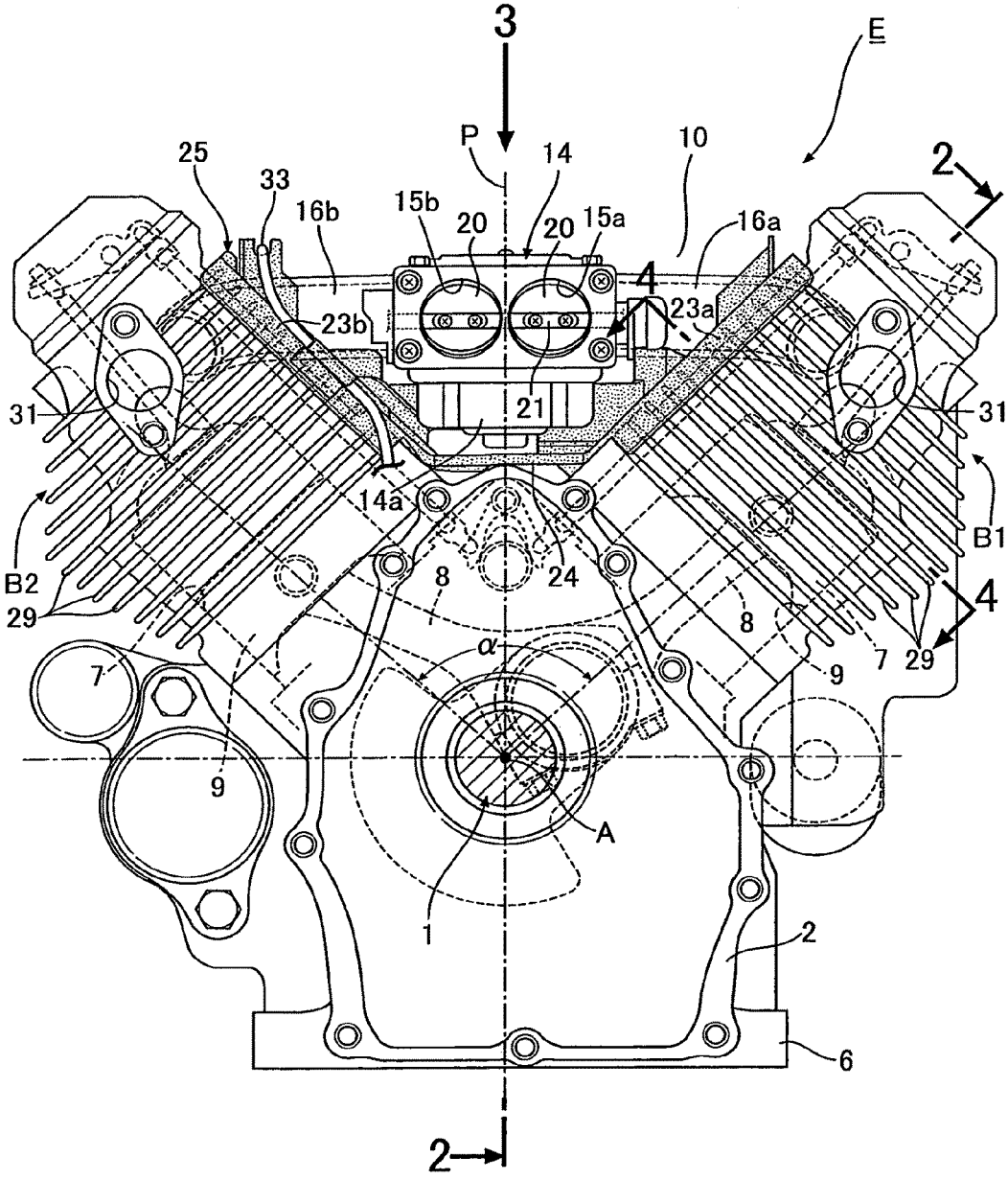
FIG. 1 is a back view of a general-purpose V-type engine of the present invention.
Figure 2:
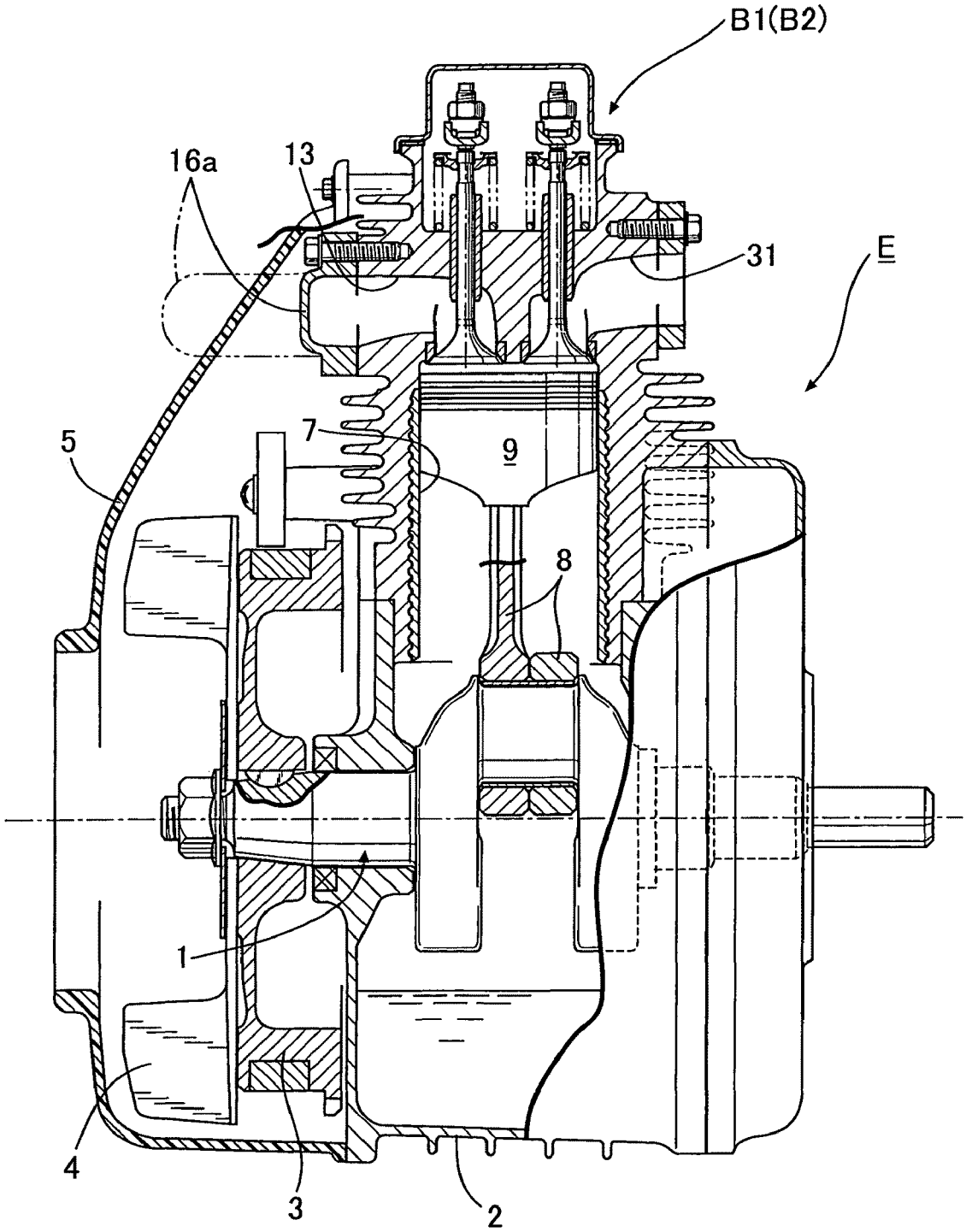
FIG. 2 is a cross-sectional view taken along a line 2-2 in FIG. 1.

In FIGS. 1 and 2, a description will be given of an example in which the present invention is implemented to a general-purpose V-type two-cylinder engine E. The V-type engine E is formed of a crankcase 2 supporting a crankshaft 1, and first and second banks B1 and B2. The first and second banks B1 and B2 are continuously provided to the crankcase 2 at a top part, and are open in a V-shape having its center on a vertical plane P including an axis A of the crankshaft 1. In the illustrated example, an included angle α between the first and second banks B1 and B2 is set to 90°. One end part of the crankshaft 1 protrudes frontward of the crankcase 2, and a flywheel 3 and a cooling fan 4 are fixed to this end part. A fan cover 5 is attached to the crankcase 2. By this fan cover 5, the outside air taken in by the cooling fan 4 is guided, as cooling air, to the surrounding of each of the banks B1 and B2 and to the surrounding of a carburetor 14 which will be described later. The other end part of the crankshaft 1 protrudes rearward of the crankcase 2, and serves as an output part. An engine installation flange 6 is integrally formed to the bottom part of the crankcase 2.

The first and second banks B1 and B2 each include a single cylinder 7. A piston 9 is fitted into the cylinder 7, while being connected to the crankshaft 1 via a connecting rod 8. Intake pipe attachment flanges 12 and 12 are formed on the head parts, at respective corner parts on the front side, which are opposite to each other, of the respective first and second banks B1 and B2. Each intake port 13 opens to an end face of a corresponding one of the intake pipe attachment flanges 12 and 12. First and second intake pipes 16*a* and 16*b* are attached to the intake pipe attachment flanges 12 and 12, respectively. The carburetor 14 is placed at a center part of a valley 10 between the banks B1 and B2. The first and second intake pipes 16*a* and 16*b* connect first and second intake paths 15*a* and 15*b* of the carburetor 14 to the intake ports 13 and 13 of the first and second banks B1 and B2, respectively. Being placed at the center part of the valley 10, the carburetor 14 is spaced from the banks B1 and B2 by an equal distance.

The first and second intake pipes 16*a* and 16*b* are joined, at their upstream ends, to a single large joint flange 17, and thus connected to each other integrally. The carburetor 14 is joined, at its downstream end face, to the large joint flange 17 by bolts. Small joint flanges 18 and 18 are formed to the respective first and second intake pipes 16*a* and 16*b* at their downstream ends. These small joint flanges 18 and 18 are joined to the respective intake pipe attachment flanges 12 and 12 by bolts 19.

As FIG. 1 shows, the first and second intake paths 15*a* and 15*b* of the carburetor 14 are located on the left and on the right, respectively, with the vertical plane P in between. Butterfly throttle valves 20 and 20 close and open the respective first and second intake paths 15*a* and 15*b*. Rotation of a common valve shaft 21 placed horizontally allows the open/close operation of the throttle valves 20 and 20. Moreover, the carburetor 14 has, at its lower part, a float chamber 14*a* common to the first and second intake paths 15*a* and 15*b*.

Figure 3:
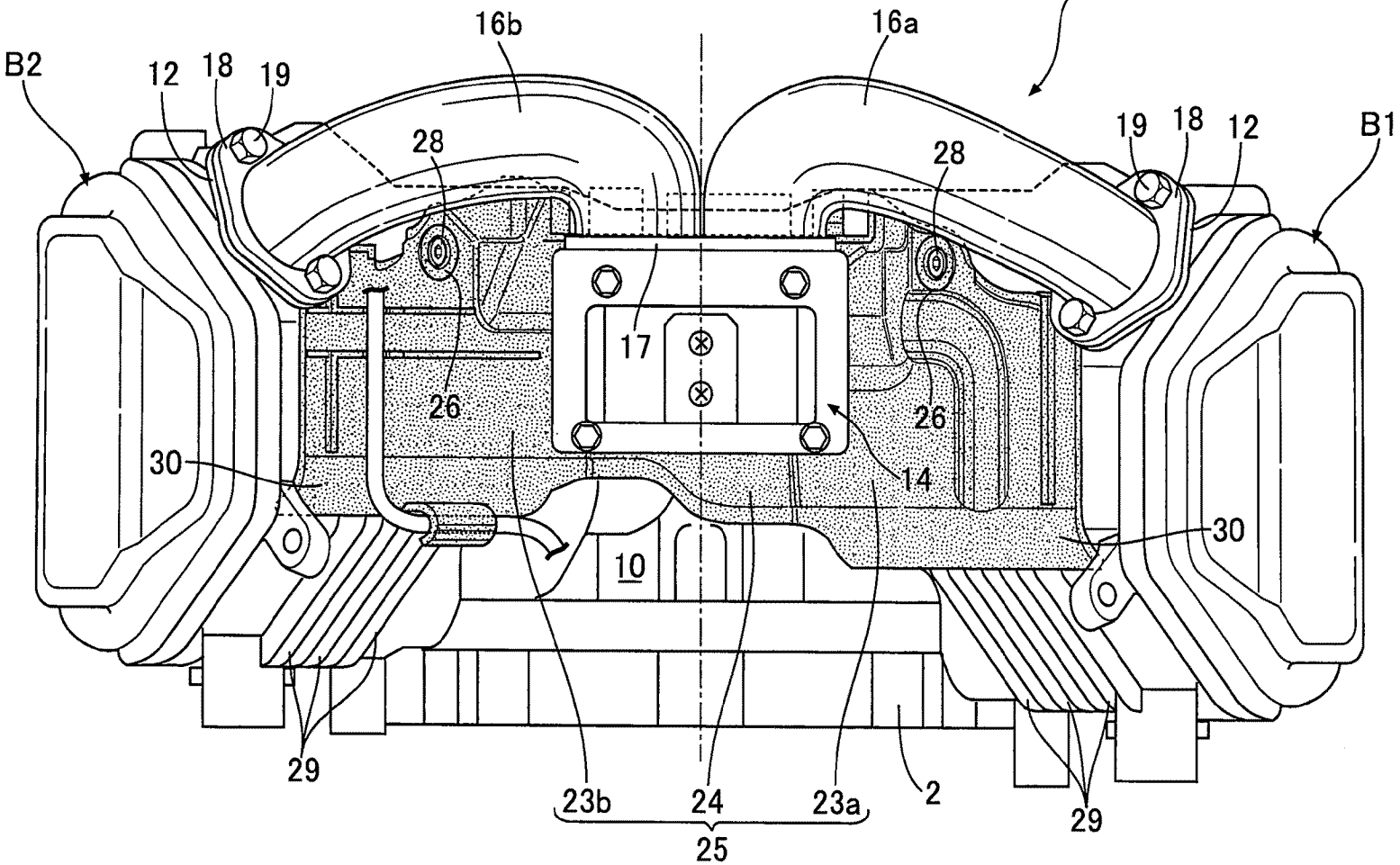
FIG. 3 is a view seen from an arrow 3 in FIG. 1.
Figure 4:
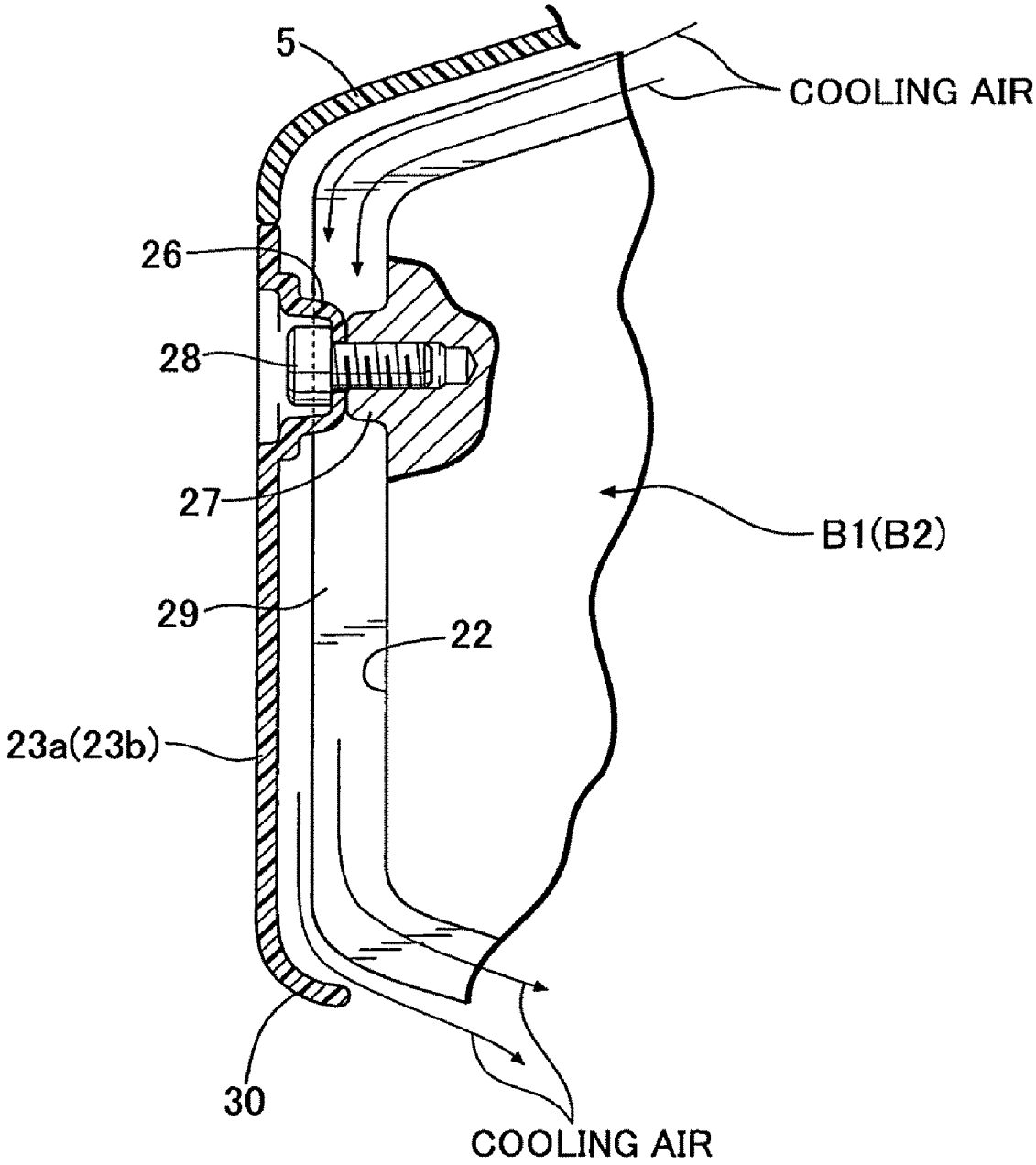
FIG. 4 is a cross-sectional view taken along a line 4-4 in FIG. 1.
Figure 5:
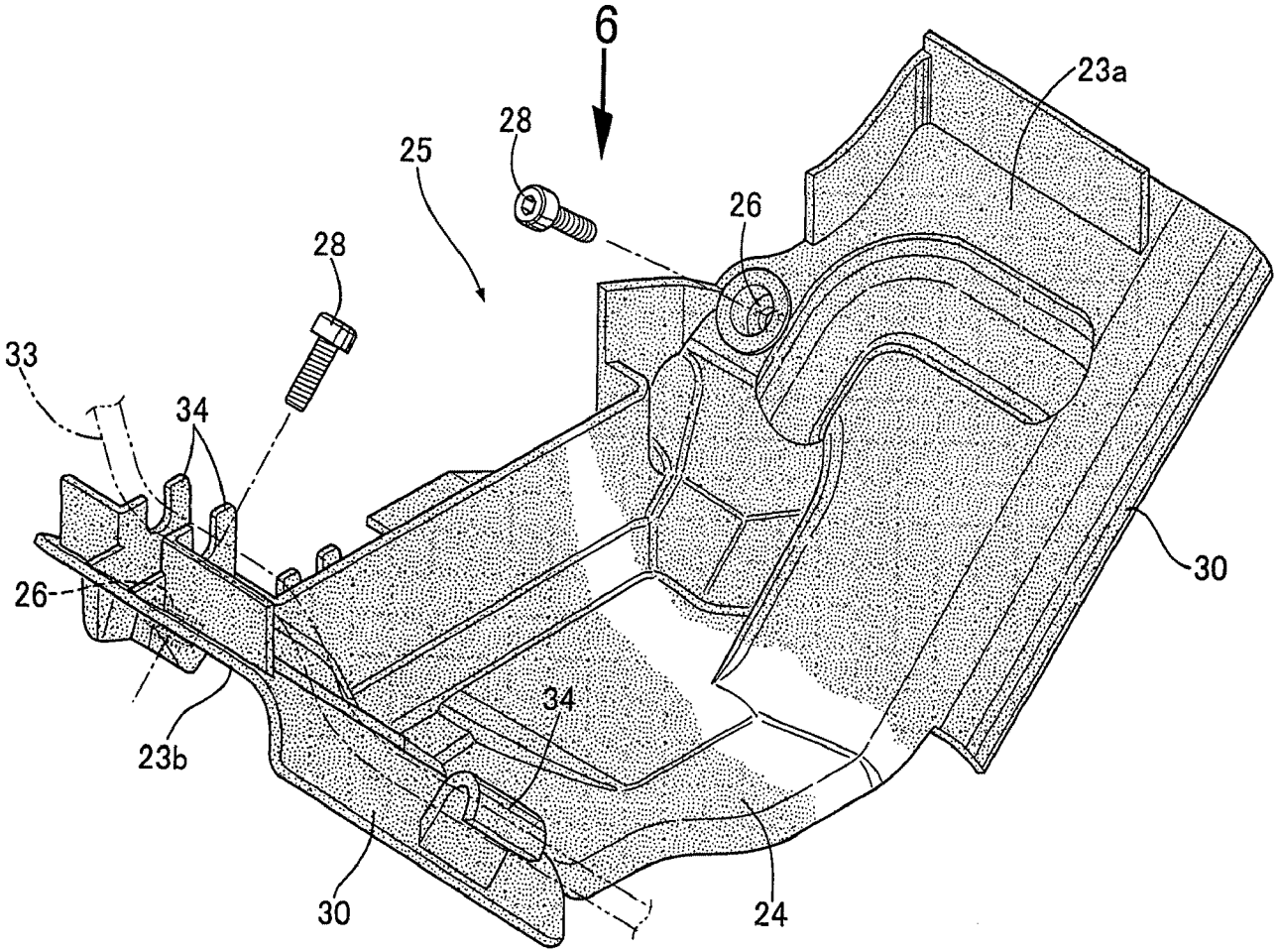
FIG. 5 is a perspective view of a single member including first and second heat shield plates to be attached to the engine.
Figure 6:
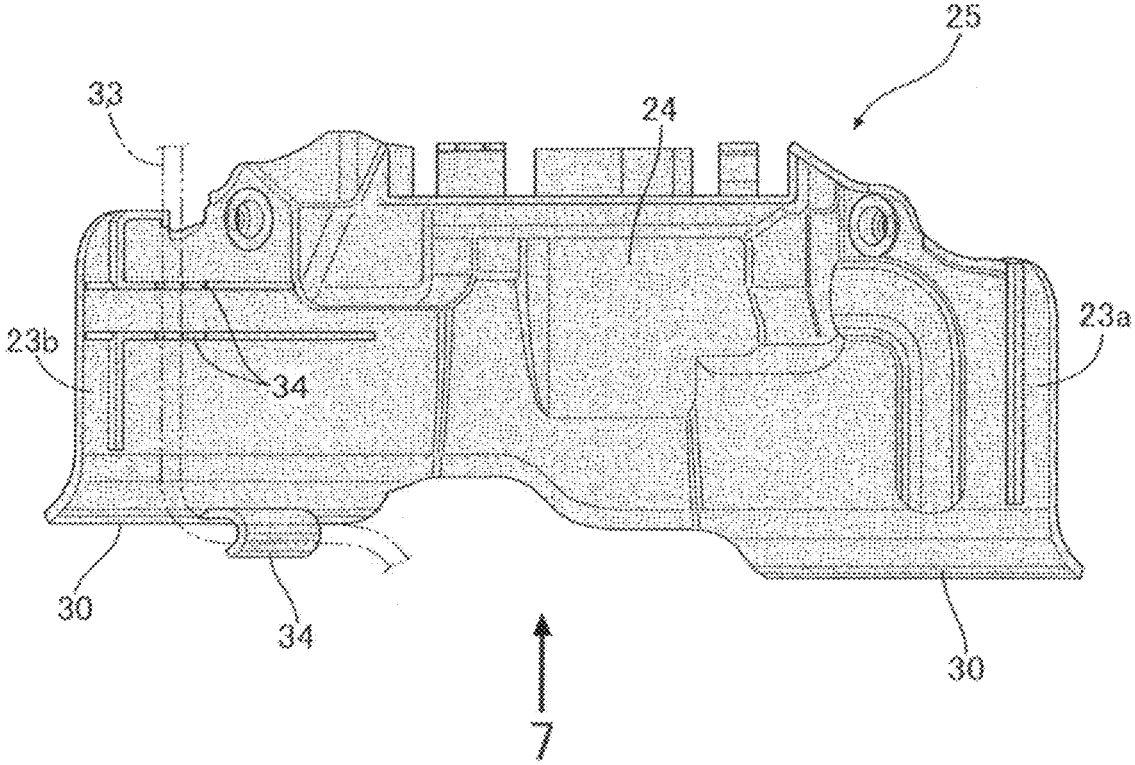
FIG. 6 is a view seen from an arrow 6 in FIG. 5.
Figure 7:
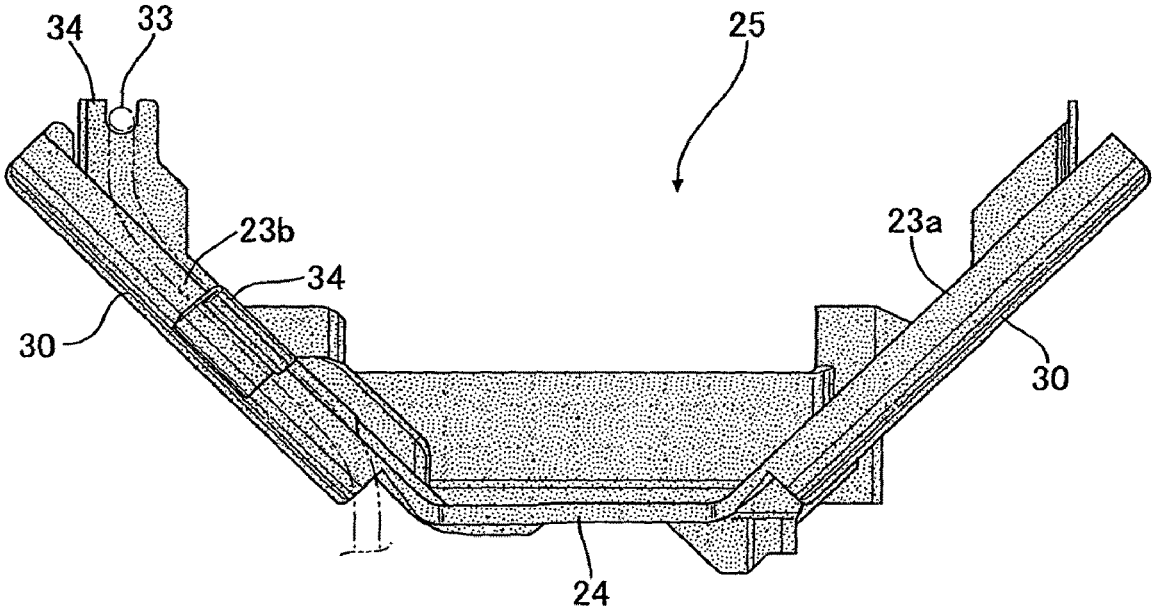
FIG. 7 is a view seen from an arrow 7 in FIG. 6.

As FIGS. 1, 3, and 4 show, first and second heat shield plates 23*a* and 23*b* each made of synthetic resin are attached respectively to side faces of the first and second banks B1 and B2, which face the carburetor 14. Each of the first and second heat shield plates 23*a* and 23*b* covers the corresponding side face and defines a cooling air passage 22 between the heat shield plate and the side face. Many cooling fins 29, 29 are formed on an outer face of each of the banks B1 and B2 in such a manner as to face the corresponding cooling air passage 22.

As FIG. 4 clearly shows, front end parts of the respective first and second heat shield plates 23*a* and 23*b*, that is, end parts at the cooling fan 4 side, are continuous with end parts of the fan cover 5 which are located at the downstream side of the cooling air. Further, a curved part 30 is formed at a rear end part of each of the first and second heat shield plates 23*a* and 23*b*. The curved part 30 guilds cooling air from a corresponding one of the cooling air passage 22 and 22 to the back face side of the corresponding bank B1 or B2.

As FIGS. 1 and 3 to 7 show, the first and second heat shield plates 23*a* and 23*b* are integrally connected to each other by a bottom plate 24 which covers the bottom face of the valley 10, and thereby the first and second heat shield plates and the bottom plate form an integrally-formed single component 25. In the single component 25, a single attachment boss 26 is formed in each of the first and second heat shield plates 23*a* and 23*b*. Moreover, a screw boss 27 is formed in an outer face of each of the banks B1 and B2. The single component 25 is attached to the V-type engine E by fixing a bolt 28 into each of the attachment bosses 26 and the corresponding screw boss 27 (see FIG. 4). By making the first and second heat shield plates 23*a* and 23*b* the single component 25 in this way, the first and second heat shield plates 23*a* and 23*b* can be attached to the V-type engine E with a small number of bolts 28.

Further, a holding part 34 is integrally formed to the single component 25 (i.e., in the illustrated example, one of the heat shield plates, 23*b*). The holding part 34 holds linear members 33 such as an electric wire for control of the V-type engine E, an operation cable, and a hose.

Referring back to FIG. 1, an opening exhaust port 31 is provided to a head part of each of the first and second banks B1 and B2. The exhaust ports 31 are provided at the back faces of the respective banks B1 and B2, which are opposite to the faces where the intake pipes 16*a* and 16*b* are provided.

Next, operations of this embodiment will be explained.

The first and second heat shield plates 23*a* and 23*b* made of synthetic resin are attached to the side faces of the first and second banks B1 and B2, which face the carburetor 14. Each of the first and second heat shield plates 23*a* and 23*b* covers the corresponding side face and defines a corresponding one of the cooling air passages 22 and 22 between the heat shield plate and the side face. The end parts of the first and second heat shield plates 23*a* and 23*b* at the cooling fan 4 side are continuous with the end parts of the fan cover 5 which are located at the downstream side of the cooling air. Accordingly, while the V-type engine E is in operation, cooling air taken in and sent under pressure by the cooling fan 4 that rotates with the crankshaft 1 is guided into the cooling air passages 22 and 22 around the respective banks B1 and B2. Thereby, the banks B1 and B2 can be cooled. Especially because the many cooling fins 29, 29 of each of the banks B1 and B2 face a corresponding one of the cooling air passage 22 and 22, the banks B1 and B2 can have improved cooling capability. Furthermore, part of the cooling air sent under pressure by the cooling fan 4 is also supplied to the carburetor 14 side, and cools the carburetor 14.

Moreover, the curved part 30 at the rear end of each of the heat shield plates 23*a* and 23*b* bends the pathway of the cooling air flowing through a corresponding one of the cooling air passage 22 and 22 of the bank B1 or B2, and the cooling air thereby travels to the back face side of the corresponding bank B1 or B2. Accordingly, the back face side of the banks B1 and B2 can be cooled well.

When the V-type engine E stops its operation in a high-temperature state, the cooling fan 4 stops rotating, and consequently the cooling air stops flowing. Accordingly, the banks B1 and B2 dissipate heat peripherally. However, the carburetor 14 can be prevented from heating up because the heat shield plates 23*a* and 23*b* interposed between the corresponding bank B1 or B2 and the carburetor 14 shield the carburetor 14 from radiation heat from the banks B1 and B2.

Furthermore, the carburetor 14 is placed at the center part of the valley 10 between the first and second banks B1 and B2 and is spaced from the banks B1 and B2. The carburetor 14 is therefore connected to the banks B1 and B2 via the relatively-long intake pipes 16*a* and 16*b*, respectively. Accordingly, heat radiation effects of the intake pipes 16*a* and 16*b* allow less heat to be conducted from the banks B1 and B2 to the carburetor 14. The carburetor 14 can thus be prevented from heating up. Percolation in the carburetor 14 can be prevented in this way, and this can contribute to improvement of the restartability of the V-type engine E in a high-temperature state.

As described, the first and second heat shield plates 23*a* and 23*b* play two functions: guidance of cooling air to the surrounding of the first and second banks B1 and B2 while the V-type engine E is in operation; and shielding of the carburetor 14 from radiation heat from the banks B1 and B2 when the V-type engine E stops its operation. This can contribute to simplification of the structure around the V-type engine E.

In addition, the paired heat shield plates 23*a* and 23*b* are integrally connected to each other by the bottom plate 24 which covers the bottom face of the valley 10 between the first and second banks B1 and B2, and thereby the first and second heat shield plates and the bottom plate form the single component 25. Since the single component 25 is integrally formed, not only can the heat shield plates 23*a* and 23*b* be manufactured at once, the single component 25 can be attached to the V-type engine E with a small number of the bolts 28. This can contribute to improvement of installation work efficiency.

Additionally, the holding part 34 is integrally formed to the single component 25 to hold the linear members 33 such as an electric wire for control of the V-type engine E, an operation cable, and a hose. Accordingly, the V-type engine E does not need to be installed with a holding member dedicated to the linear members 33. This can contribute to reduction in the number of components.

The present invention is not limited to the above-mentioned embodiment and may be modified in a variety of ways as long as the modifications do not depart from its gist. As the carburetor 14, independent first and second carburetors may be individually connected to the first and second intake pipes 16*a* and 16*b*, respectively. The present invention can be applied to a general-purpose V-type engine of a vertical type in which the crankshaft is placed upright.

The invention claimed is:

1. A V-type engine in which first and second banks arranged in a V-shape are provided continuously to a crankcase which supports a crankshaft horizontally, a carburetor is located at a valley between the first and second banks, the carburetor communicating with intake ports of the respective banks, a cooling fan is fixed to one end portion of the crankshaft, and a fan cover is attached to the crankcase, the fan cover guiding outside air taken in by the cooling fan, as cooling air, to a surrounding of the first and second banks, wherein the carburetor is a twin carburetor having first and second intake paths which are arranged in a direction of arrangement of the first and second banks and extends in the horizontal direction, and is disposed so that the carburetor is entirely housed in the valley and is spaced apart from the first and second banks, the first and second intake paths of the carburetor are respectively connected to the intake ports of the first and second banks via first and second intake pipes which are respectively bent outwards sideways of the valley to a U-shape on a horizontal plane, first and second heat shield plates each made of synthetic resin, extending along a corresponding one of side faces of the first and second banks, and covering the side face are attached to the respective side faces, the side faces facing the carburetor, and a cooling air passage is defined between each of the first and second heat shield plates and a corresponding one of the side faces of the first and second banks, the cooling air passage extending along the side face, and an end portion on a cooling air downstream side of the fan cover comes into contact with the respective end portions on the cooling fan side of the first and second heat shield plates so that each of the heat shield plates is continuous with the face cover, and the cooling air taken in and sent under pressure by the cooling fan is guided from the inside of the fan cover to the cooling air passage side.

2. The V-type engine according to claim 1, wherein the first and second heat shield plates are integrally connected to each other by a bottom plate covering a bottom face of the valley, whereby the first and second heat shield plates and the bottom plate form a single component.

3. The V-type engine according to claim 2, wherein a holding part for holding a linear member is integrally formed to the single component.

* * * * *